US008925851B2

(12) United States Patent
Tracey et al.

(10) Patent No.: US 8,925,851 B2
(45) Date of Patent: Jan. 6, 2015

(54) APPARATUS FOR MOUNTING A REEL

(75) Inventors: James B. A. Tracey, Austin, TX (US); Richard Ceraldi, Austin, TX (US)

(73) Assignee: Great Stuff, Inc., Austin, TX (US)

( * ) Notice: Subject to any disclaimer, the term of this patent is extended or adjusted under 35 U.S.C. 154(b) by 197 days.

(21) Appl. No.: 13/566,097

(22) Filed: Aug. 3, 2012

(65) Prior Publication Data

US 2013/0032655 A1 Feb. 7, 2013

Related U.S. Application Data

(60) Provisional application No. 61/515,799, filed on Aug. 5, 2011.

(51) Int. Cl.
*B65H 75/38* (2006.01)
*B65H 75/44* (2006.01)

(52) U.S. Cl.
CPC ..... *B65H 75/4463* (2013.01); *B65H 75/4471* (2013.01); *B65H 75/38* (2013.01); *B65H 2701/34* (2013.01)
USPC ..... 242/406; 242/398; 242/130.2

(58) Field of Classification Search
CPC ..... B65H 75/4463; B65H 49/22
USPC ..... 242/398, 399.2, 406, 130.2
See application file for complete search history.

(56) References Cited

U.S. PATENT DOCUMENTS

| | | | | |
|---|---|---|---|---|
| 825,199 | A | 7/1906 | Dugdill | |
| 3,490,715 | A * | 1/1970 | Nicpon | 242/385.3 |
| 5,101,082 | A * | 3/1992 | Simmons et al. | 191/12.2 R |
| 5,209,420 | A | 5/1993 | Simmons et al. | |
| 5,215,272 | A | 6/1993 | Sauber | |
| 5,593,107 | A | 1/1997 | Focke et al. | |
| 6,170,775 | B1 | 1/2001 | Kovacik et al. | |
| D491,444 | S | 6/2004 | Nicholls | |
| 6,786,428 | B1 | 9/2004 | Huang | |
| D554,479 | S | 11/2007 | Rosine et al. | |
| 7,419,038 | B2 | 9/2008 | Caamano et al. | |
| 7,533,843 | B2 | 5/2009 | Caamano et al. | |
| 7,810,751 | B2 | 10/2010 | Caamano et al. | |
| D626,818 | S | 11/2010 | Tracey | |
| D632,548 | S | 2/2011 | Tracey et al. | |
| 7,931,133 | B2 | 4/2011 | Vannest | |
| 2007/0194163 | A1 | 8/2007 | Okonsky et al. | |

OTHER PUBLICATIONS

International Search Report and Written Opinion for PCT Application No. PCT/US2012/049626 filed Aug. 3, 2012, mailed Oct. 16, 2012.

(Continued)

*Primary Examiner* — Sang Kim
(74) *Attorney, Agent, or Firm* — Knobbe Martens Olson & Bear, LLP

(57) ABSTRACT

A reel mounting assembly can include a base and a reel support. The base can be configured to mount to a surface. The reel support can be configured to support a reel hanging from the reel support. The base and reel support each have engagement elements configured to pivotably engage one another, such that the base and the reel support can pivot with respect to each other about at least two approximately orthogonal axes extending through the engagement elements. The reel mounting assembly can be provided in combination with a reel. The reel mounting assembly can provide self-leveling features for a reel.

26 Claims, 10 Drawing Sheets

(56) References Cited

OTHER PUBLICATIONS

Industrial Electronics and Digital Signage, Wall Mount/Ball-and-Socket Joint by Crystal Display Electronics AG Switzerland; www.crystal-cde.com.

Speaker Mounts, The Circuits Shop, Electronics in Meccano, found at: http://www.eleinmec.com/shop__category.asp?1208-speaker-mounts, viewed on Jul. 28, 2011.

Gison Pneumatic Tools: Handy Air Hose Reel found at: www.gison.com, viewed on Jul. 20, 2011.

* cited by examiner

FIG. 2A
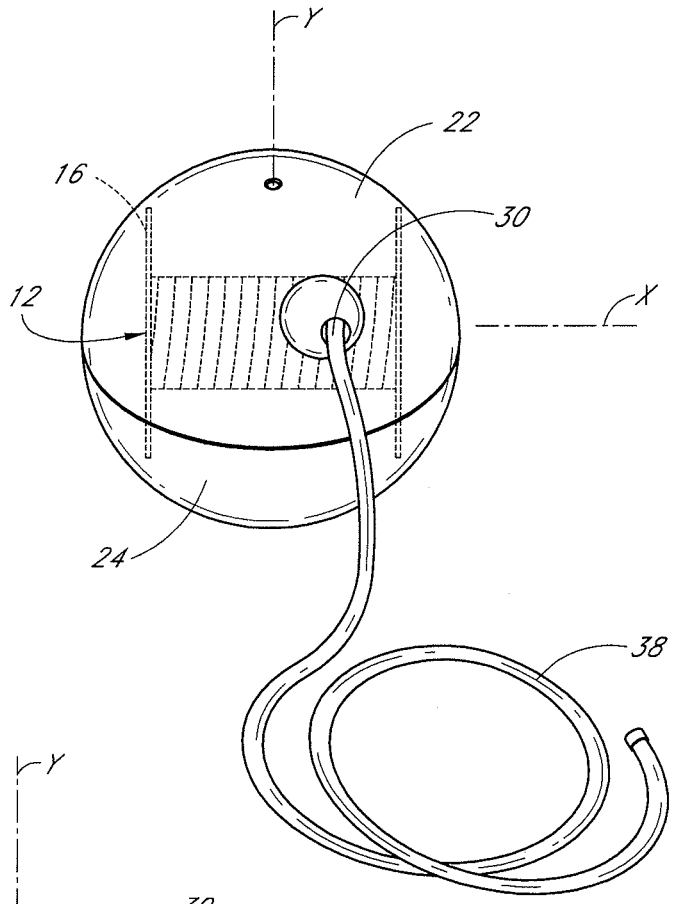
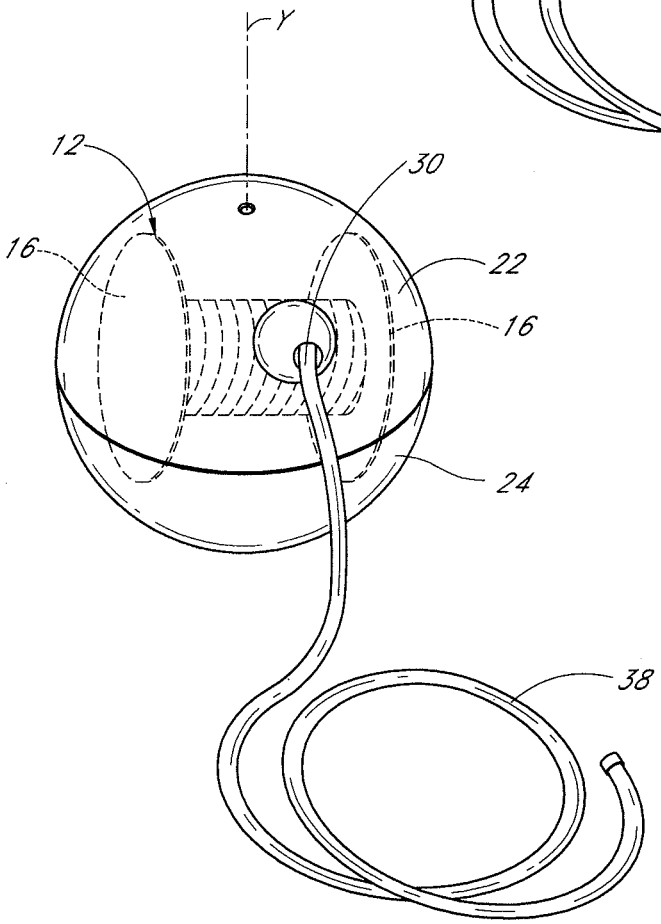
FIG. 2B

APPARATUS FOR MOUNTING A REEL

CLAIM FOR PRIORITY

The present application claims priority benefit under 35 U.S.C. §119(e) to Provisional Application No. 61/515,799, filed Aug. 5, 2011, the entire contents of which are incorporated by reference and should be considered a part of this specification.

INCORPORATION BY REFERENCE

This application hereby incorporates by reference herein the full disclosures of U.S. Pat. No. 7,350,736 to Caamano et al.; U.S. Pat. No. 7,419,038 to Caamano et al.; U.S. Pat. No. 7,533,843 to Caamano et al.; U.S. Pat. No. 7,503,338 to Harrington et al.; U.S. Provisional Patent Application No. 61/477,108, filed Apr. 19, 2011, entitled "Systems and Methods for Spooling and Unspooling Linear Material;" U.S. Provisional Patent Application No. 61/378,861, filed Aug. 31, 2010, entitled "Electrical Cord Reel with Control System to Limit Overheating;" and U.S. Patent Application Publication No. 2008-0223951-A1 to Tracey et al.

BACKGROUND

1. Field

This application relates generally to reels for spooling linear material and specifically to apparatus for mounting reels for spooling linear material.

2. Description of the Related Art

Motorized reels are used for spooling linear materials, such as hoses or electrical cords. Exemplary motorized reels are disclosed in U.S. Pat. No. 7,419,038 to Caamano et al. and U.S. Pat. No. 7,533,843 to Caamano et al.

Conventional reels may include legs, a frame, or other support structure, without an anchoring system, allowing the reels to rest upon the top of a horizontal surface, such as a bench. Some conventional reels include anchors to anchor the reels to the bottom of a horizontal surface, such as a ceiling, or a vertical surface, such as a wall.

SUMMARY

In one embodiment, the present application provides a reel mounting assembly comprising a base and a reel support. The base is configured to mount to a surface. The reel support is configured to support a reel hanging from the reel support. The base and reel support each have engagement elements configured to pivotably engage one another, such that the base and the reel support can pivot with respect to each other about at least two approximately orthogonal axes extending through the engagement elements.

In another embodiment, the present application provides a reel mounting assembly comprising a base, a reel support and a ball and socket assembly. The base is configured to mount to a surface. The reel support is configured to support a reel hanging from the reel support. The ball and socket assembly is configured to pivotably engage the base and the reel support with one another, such that the base and the reel support can provide self-leveling to a reel hanging from the reel support.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught or suggested herein without necessarily achieving other objects or advantages as may be taught or suggested herein.

All of these embodiments are intended to be within the scope of the invention herein disclosed. These and other embodiments will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIGS. 2A and 2B are perspective, partially cut-away views of the reel of FIG. 1, illustrating reciprocation of the rotatable member on which a linear material is spooled.

DETAILED DESCRIPTION

Conventional mounting assemblies for reels require the user to repeatedly de-anchor and re-anchor the reel each time the user desires to move the reel to a new location. Additionally, it is difficult for a user to support a conventional reel while mounting it on less-accessible surfaces, such as a wall or ceiling. Conventional mounting assemblies for reels are fixed or have limited freedom of motion about a single axis, which limit the ability to mount conventional reels on some surfaces. Additionally, conventional reel mounting assemblies are limited in the number of angles from which linear material can be wound accurately and consistently around a reel. The spooling process of a reel anchored by a conventional reel mounting assembly also creates shock to the reel and the material being spooled, which can exacerbate inaccuracies and inconsistencies in the winding.

Disclosed herein are embodiments of a mounting assembly for a reel that facilitates mounting and dismounting of the reel to a variety of surfaces at a variety of orientations. Also disclosed are embodiments of a reel mounting assembly that provide a self-leveling functionality and freedom of movement of the reel in a variety of directions, and decreases shock during the spooling process. Some disclosed embodiments provide a mounting assembly for a reel that can be mounted on a surface at virtually any inclination or angle. Some disclosed embodiments provide a mounting assembly for a reel that include a base and a reel support that can pivot in virtually any direction. It should be understood that the disclosed embodiments present examples of the present inventions for illustrative purposes, and that the scope of the present inventions is not limited to the embodiments disclosed herein.

Exemplary Reel

Prior to describing a reel mounting assembly, a suitable embodiment of a reel is first described for context.

Figure 1:
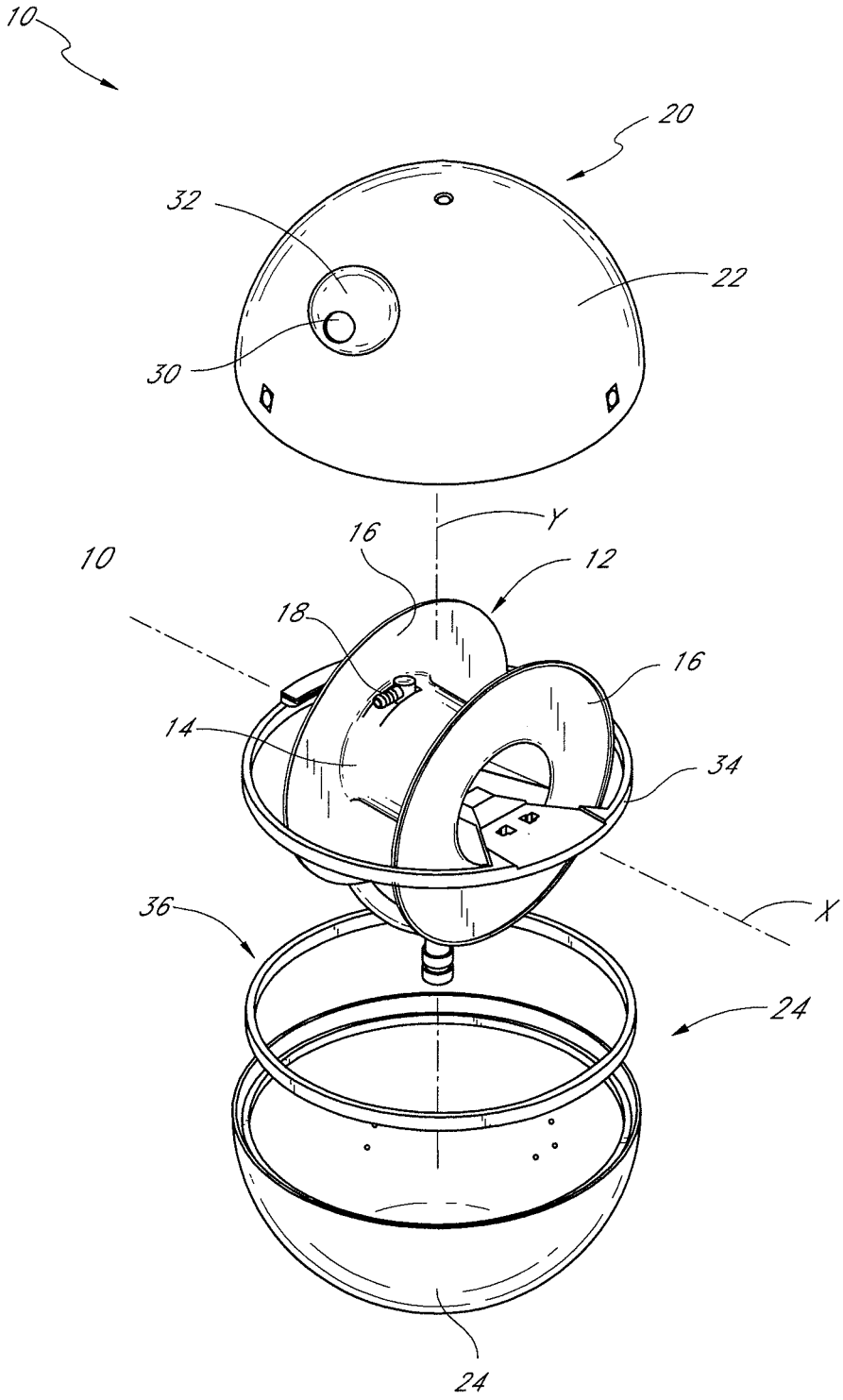
FIG. 1 is a perspective view of a disassembled reel.

FIG. 1 is a perspective view of a disassembled reel 10 in accordance with an embodiment of the invention. It will be appreciated that the principles of the invention may be embodied in a large variety of reels of different configurations and functionalities, and that the reel 10 is just one exemplary embodiment. The basic configuration of the illustrated reel 10 is described below. However, additional details of embodiments of the reel 10 are found in U.S. Pat. No. 7,533,843.

The illustrated reel 10 comprises a rotatable member 12 (also referred to as a spool member) onto which a linear material can be spooled. For example, the spooled linear material can comprise a fluid hose or an electrical cord. The illustrated rotatable member 12 comprises a substantially cylindrical drum comprising a cylindrical member 14 sandwiched between a pair of end plates 16 that retain the spooled linear material on the member 14. It will be understood that the member 14 need not be cylindrical. It will also be understood that the member 14 can have openings and can even comprise a cage-like structure. The illustrated rotatable member 12 spools the linear material by rotating about a substantially horizontal spooling axis X. In other embodiments, a reel can have a rotatable member that rotates about a non-horizontal spooling axis. For example, U.S. Pat. No. 7,419,038 discloses a reel with a rotatable member that rotates about a vertical spooling axis.

Although not shown in FIG. 1, the reel 10 preferably includes a motor that powers the rotation of the rotatable member 12 about the spooling axis X. The motor is preferably an electric motor and can be remote-controlled. A suitable gear reduction assembly can be provided between the motor and the rotatable member 12. The motor can be configured to rotate in two different directions to allow a user to selectively wind or unwind the linear material using the motor. For example, the motor can be configured to assist the user in unwinding the linear material when a control system of the reel 10 detects a certain degree of tension in the linear material. This is referred to as "powered assist" or "reverse assist" functionality. Additionally, a motor controller can monitor approximately or exactly how much linear material is spooled onto the rotatable member 12, and how much linear material is unwound from the reel 10, for example by keeping track of the number and direction of revolutions of the rotatable member 12 about the spooling axis X. With advanced knowledge of the total length of the linear material, the motor controller can use the number and direction of revolutions of the rotatable member to compute the spooled length and/or deployed length of the linear material. A "docking" functionality can be implemented, whereby the automatic device reduces its rotational speed during the winding of a distal end portion of the linear material about the rotatable member 12.

A suitable motor and motor-control assembly, including examples of a reel with tension monitoring, powered assist, reverse assist, and docking functionality, is disclosed in U.S. Pat. No. 7,350,736. Examples of a hose reel with a remote-control for controlling a motor and a flow-controller are disclosed in U.S. Pat. No. 7,503,338 and U.S. Patent Application Publication No. 2008-0223951-A1. Examples of a ceiling-mounted reel with docking functionality are disclosed in U.S. Provisional Patent Application No. 61/477,108, filed Apr. 19, 2011.

It is possible for there to be some slackened (i.e., unspooled) linear material between the housing aperture 30 and the rotatable member 12. In some applications, it may be desirable to monitor for such slack, to prevent bunching up of the linear material within the housing 20. A slack monitoring system can be provided to detect such slack. For example, a slack monitoring system can comprise an assembly near the aperture 30 that monitors exactly how much linear material slides through the aperture 30, and in which direction. A suitable slack monitoring system is disclosed in U.S. Provisional Patent Application No. 61/477,108, filed Apr. 19, 2011.

The illustrated rotatable member 12 preferably has a connector 18 for connecting the spooled linear material to the rotatable member 12. The illustrated connector 18 is a hose fitting for connecting a hose to the rotatable member 12. In embodiments in which the reel 10 spools a fluid hose, a fluid-conducting structure can be provided to allow the connector 18 to fluidly communicate with an external fluid source, such as a water supply, so that the hose connected to the connector 18 can receive and deliver the fluid. In an alternative embodiment, the connector 18 comprises an electrical connector that connects with an electrical cord and delivers electrical power to the cord. In such an embodiment, an electrical power conducting structure can be provided to allow the connector 18 to electrically communicate with an external electrical power source, so that the electrical cord connected to the connector 18 can receive and deliver the electrical power. In some embodiments, one or more temperature switches and/or sensors can be integrated into the reel 10, for example, to prevent overheating. Examples of a reel with one or more temperature switches and/or sensors are disclosed in U.S. Pat. No. 7,419,038 and U.S. Provisional Patent Application No. 61/378,861.

The reel 10 preferably includes a housing 20 that substantially encloses the rotatable member 12 and the linear material spooled thereon. In the illustrated embodiment, the housing 20 comprises an upper housing portion 22 and a lower housing portion 24. It will be appreciated that the housing 20 may comprise any suitable number of housing portions. For example, U.S. Pat. No. 7,419,038 discloses a reel with three housing portions. Alternatively, the housing 20 may comprise only one housing portion. The illustrated housing 20 is substantially spherical. However, it will be understood that embodiments of reels can have housings of various shapes.

The lower housing portion 24 can be connected to a support structure that supports the reel 10 with respect to a lower support surface, such as the ground or a workbench. It will be appreciated that a wide variety of different types of support structures can be provided. In some embodiments, the support structure can comprise a plurality of legs adapted to contact the support surface. It will be appreciated that any suitable number of legs can be provided. In certain embodiments, the legs comprise rollers or wheels that permit a user to roll the reel 10 along the support surface. In certain such embodiments, the rollers or wheels can have locks that prevent such movement of the reel 10. U.S. Pat. Nos. 7,533,843 and 7,419,038 disclose examples of support structures to support a reel on a support surface.

The upper housing portion 22 preferably includes an aperture 30 through which the linear material extends during usage of the reel 10. In other words, the linear material slides through the aperture 30 as the linear material is spooled or unspooled with respect to the rotatable member 12. The aperture 30 can have any suitable size and shape, such as a substantially circular, elliptical, triangular, or diamond-like shape. While the illustrated aperture 30 is provided within an outwardly protruding "nose cone" 32, it will be understood that the nose cone 32 can be omitted, with the aperture 30 directly within a main body of the upper housing portion 22. Skilled artisans will understand that the aperture 30 can be located within any one of one or more housing portions that collectively form the housing 20.

In a preferred embodiment, the upper housing portion 22 and rotatable member 12 are configured to rotate together about an axis Y (illustrated as a vertical axis) with respect to the lower housing portion 24. This can allow a user to more easily draw and utilize the linear material in any direction relative to the reel 10. A suitable configuration for providing this functionality is disclosed in U.S. Pat. No. 7,533,843 and involves an upper ring 34 of the upper housing portion 22, and a lower ring 36 of the lower housing portion 24. In one embodiment, the upper and lower rings 34 and 36 engage one another and rotate with respect to each other about the axis Y.

In a preferred embodiment, the rotatable member 12 and the upper housing portion 22 are linked together to permit a certain amount of relative rotation therebetween with respect to the axis Y. The linkage can include a reciprocating mechanism that produces a reciprocating rotation of the rotatable member 12 with respect to the upper housing portion 22 about the axis Y during rotation of the rotatable member 12 about the spooling axis X. This feature causes the aperture 30 to reciprocatingly rotate about an arc in front of the cylindrical member 14, which can improve the uniformity of the spool. A suitable example of a linkage and reciprocating mechanism for this purpose is disclosed in U.S. Pat. No. 7,533,843.

FIGS. 2A and 2B illustrate the operation of the reel 10 having such a reciprocating mechanism. In FIG. 2A, a hose 38 is partially wound upon the rotatable member 12 and extends through the aperture 30 of the upper housing portion 22. With reference to FIG. 2B, as the rotatable member 12 rotates about the spooling axis X to wind or unwind the hose 38, the rotatable member 12 reciprocatingly rotates with respect to the upper housing portion 22 about the axis Y. During this process, the orientation of the spooling axis X varies.

Figure 3A:
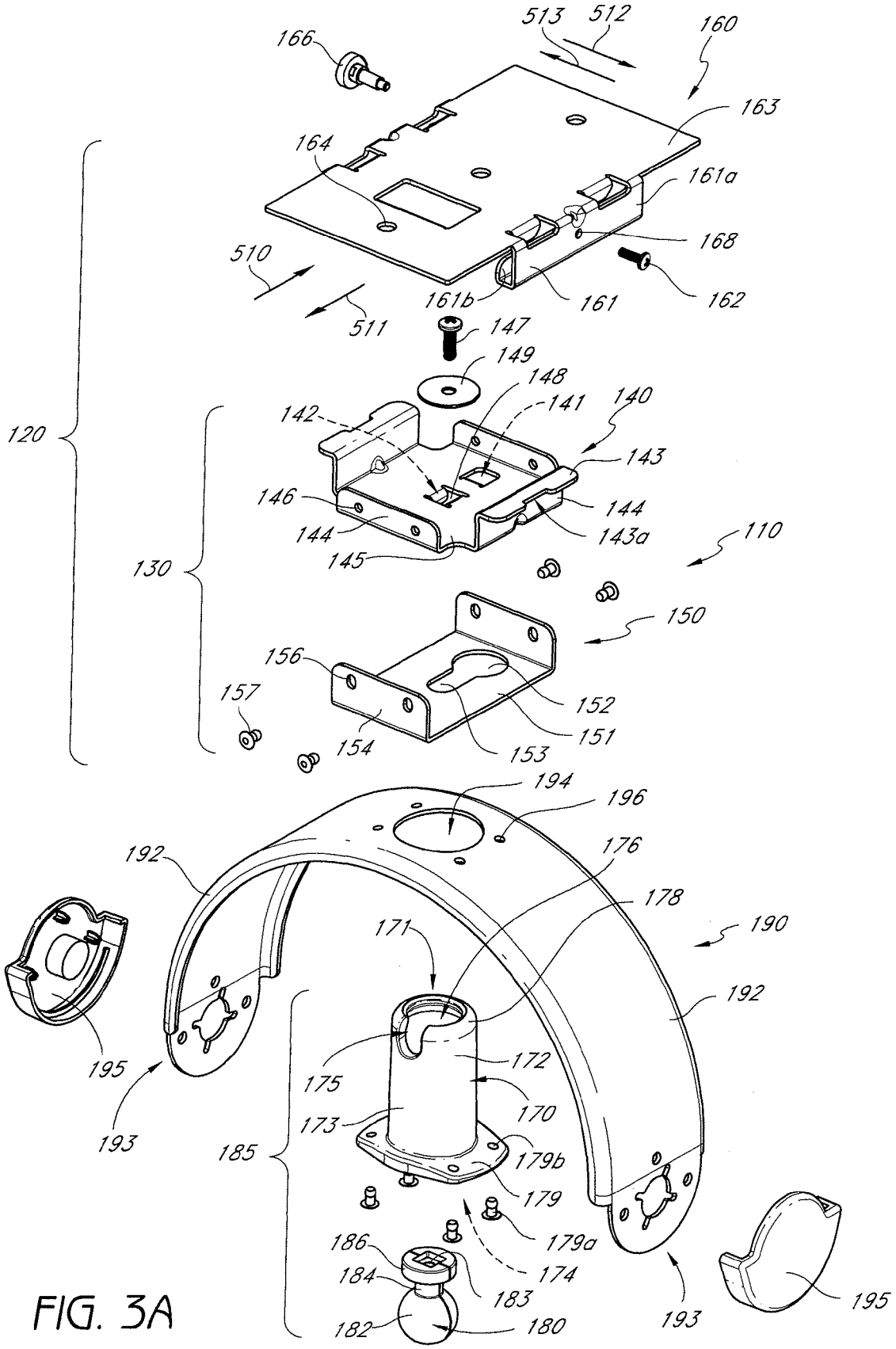
FIG. 3A is a front top perspective view of an embodiment of a disassembled reel mounting assembly.
Figure 3B:
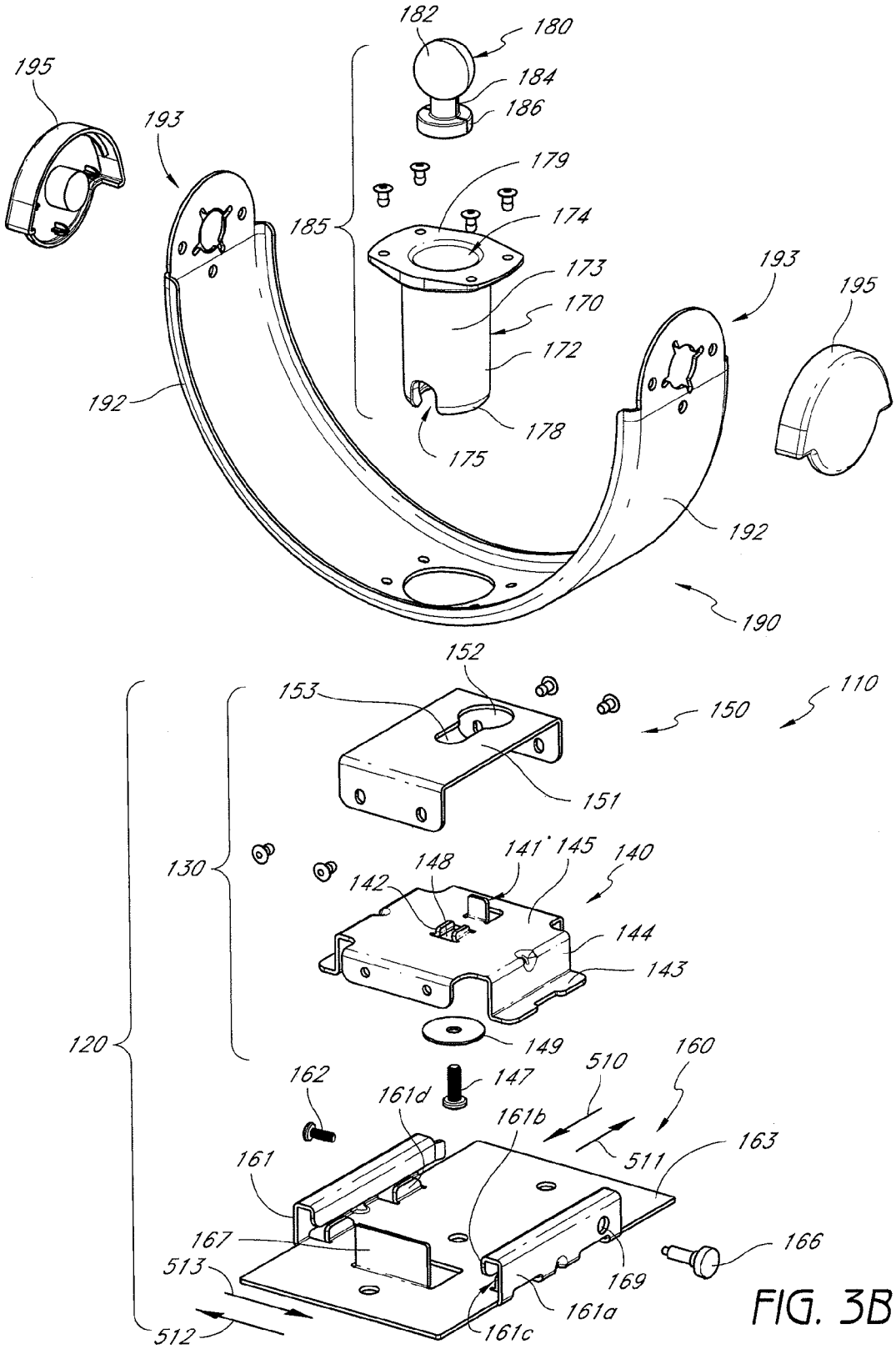
FIG. 3B is a front bottom perspective view of an embodiment of a disassembled reel mounting assembly.
Figure 3C:
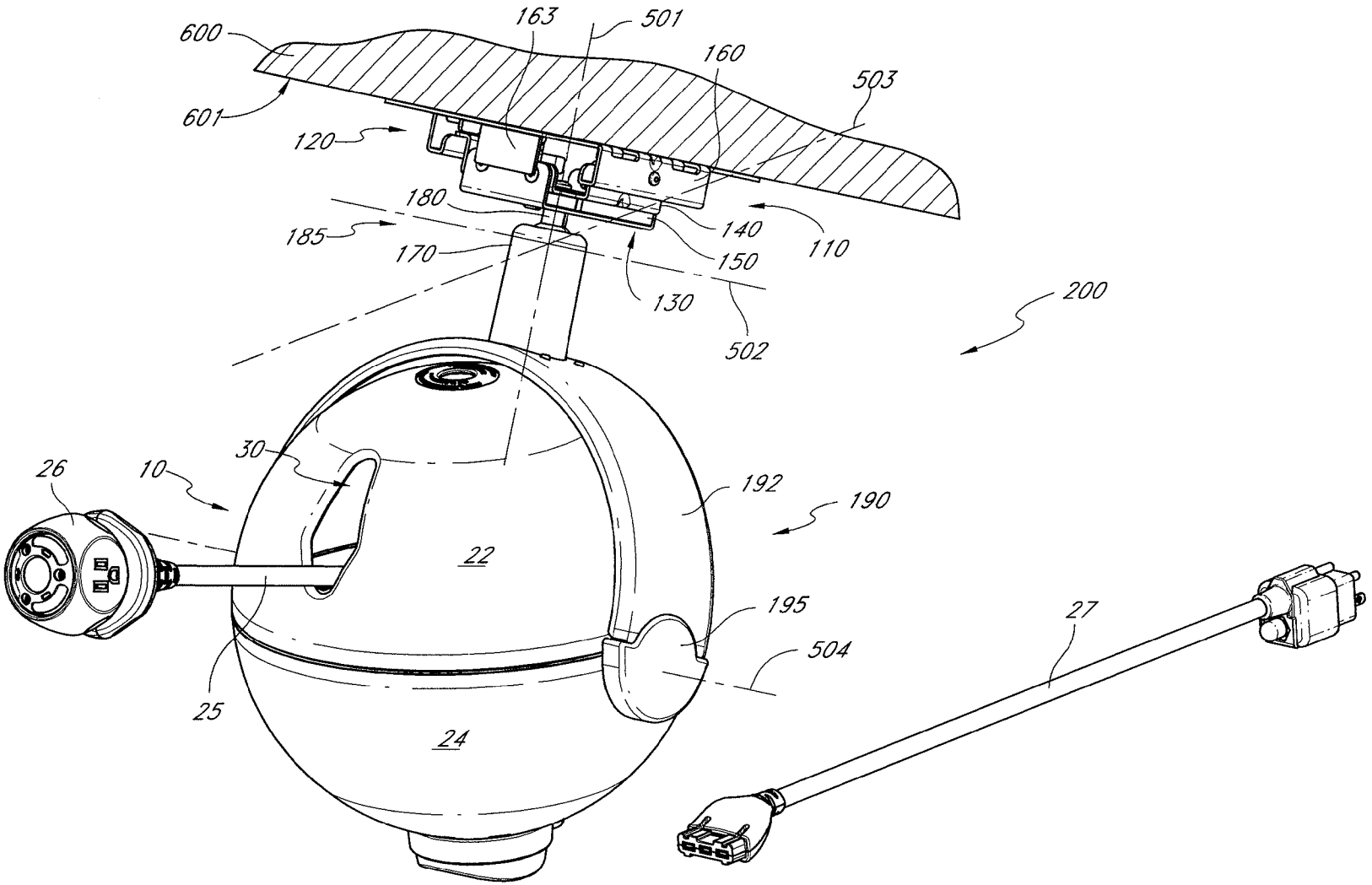
FIG. 3C is a front perspective view of an embodiment of an assembled reel mounting assembly supporting a reel.

FIG. 3A is a front top perspective view of a disassembled reel mounting assembly 110. FIG. 3B is a front bottom perspective view of a disassembled reel mounting assembly 110. FIG. 3C is a front perspective view of an assembled reel mounting assembly supporting a reel 10. Referring to FIGS. 3A-3C, reel mounting assembly 110 can comprise a base 120 configured to mount to a surface 601 (e.g., a surface 601 of a ceiling, wall, bench, or other support structure 600; FIG. 3C). It will be understood that "mount to" as used herein can mean directly mounted to, or with one or more intervening structures. Mounting assembly 110 can comprise a reel support 190 configured to support a reel 10 hanging from the reel support 190. The base 120 and reel support 190 can each have engagement elements 170, 180 configured to pivotably engage one another. Engagement elements 170, 180 can pivotably engage one another such that the base 120 and the reel support 190 can pivot with respect to each other about at least two approximately orthogonal axes extending through the engagement elements 170, 180 (e.g., at least two of axes 501-503; FIGS. 3C and 4-6C). In some embodiments, base 120 and the reel support 190 can pivot with respect to each other about any axis within a plane containing two of axes 501-503.

It will be understood that support structure 600 and surface 601 as disclosed herein are an environment of use, and thus the invention is not to be limited to include the structure 600 or surface 601. It will also be understood that although many of the embodiments herein describe the use of reel mounting assembly 110 in conjunction with the reel 10, the reel mounting assembly 110 can be manufactured and provided independently without a reel. Thus, the invention is not to be limited to require the reel with the reel mounting assembly. In some embodiments, the reel mounting assembly 110 can be provided to a user without a reel 10, and the user can provide a separate reel to be used with the reel mounting assembly 110. Additionally, reel mounting assembly 110 can be implemented with any type of reel for spooling linear material, although reel 10 is a cord reel for spooling a cord 25 with a connector 26 at its distal end. Connector 26 can include one or more power receptacles for receiving a power cord to a device, and, optionally, one or more buttons or switches to remotely turn off or shut off the power flowing through the cord, the motor/rewind/wind functionality of the reel, and/or can provide a control signal setting a docking length of the cord, as described elsewhere herein. The reel 10 can also include a cord 27 that can supply power to the reel, and thus, to connector 26. Cord 27 can be disconnectable from the remainder of reel 10. The reel mounting assembly 110 and the reel 10 can be supplied as a kit, wherein the reel mounting assembly 110 and the reel 10 can be supplied separately and then assembled by the user.

Base 120 can be any of a variety of shapes and/or materials configured to mount to a surface (e.g., surface 601) and engage with reel support 190 and with an engagement element (e.g., engagement element 180) such that base 120 can pivot with respect to reel support 190. Base 120 can comprise metal (e.g., sheet metal), plastic, or any other suitable material or combination of materials suitable to support a reel. Base 120 can be any 3-dimensional shape with a round, oval, square, rectangular, or other regular or irregular cross-sectional shape. Base 120 can include substantially straight or tapered walls, and/or can be a solid, semi-solid, and/or hollow structure. Base 120 can be a single, integrated, piece (e.g., FIG. 6C) and is not limited to two or more components such as some of the illustrated embodiments described herein. In the illustrated embodiment, base 120 can include a surface engagement portion 160 configured to mount base 120 to a surface, and an optional movable portion 130 configured to movably engage with surface engagement portion 160.

Surface engagement portion 160 can be any shape and material suitable to mount surface engagement portion 160 to a surface, such as the shapes and materials described generally herein for base 120, or other suitable shapes. Surface engagement portion 160 can be configured to mount or attach (e.g., permanently or removably) to a surface in a variety of ways, such as with a snap fit, hooks, clamps, latching, bonding, adhesive, fasteners, threads, and the like. In the illustrated embodiment, surface engagement portion 160 comprises a body or plate 163 with one or more openings 164 through which a fastener can be extended for mounting surface engagement portion 160. The quantity and pattern of openings 164 can be varied, and the embodiments in FIGS. 3A-3C are for illustrative purposes only.

Movable portion 130 can be any shape and material suitable to movably engage with surface engagement portion 160 and to engage with an engagement element (e.g., element 180), such as the shapes and materials described generally herein for base 120, or other suitable shapes. Movable portion 130 can be configured to mount or attach to surface engagement portion 160 in a variety of ways, such as those described herein for attaching surface engagement portion 160 to a surface, or other ways known or described herein, with additional movable functionality. Movable portion 130 and surface engagement portion 160 can each comprise a unitary construction, or can comprise one or more subcomponents or portions.

In the illustrated embodiment, movable portion 130 comprises an optional upper portion 140 and a lower portion 150, configured to engage with each other. Portions 140 and 150 can provide additional optional functionality described further herein with respect to the engagement between movable portion 130 and engagement element 180. Portions 140, 150 can be separately or integrally formed with respect to each other. Portions 140, 150 can comprise any shape and/or material described generally herein for base 120, and/or can engage with each other with any of a number of different engagement methods and structures described herein. In the illustrated embodiment, upper portion 140 and lower portion 150 can comprise bodies or plates 145, 151, respectively, with one or more walls 144, 154, respectively, extending therefrom. Walls 144, 154 can be configured to engage with each other with a snap or friction fit, bonding, welding, fasteners, threads, etc. In the illustrated embodiment, walls 144, 154 include one or more openings 146, 156, respectively (e.g., threaded or non-threaded), through which fasteners 157 can be extended to engage portions 140, 150 with each other.

In some embodiments, movable portion 130 and surface engagement portion 160 can be configured to movably (e.g., slidably) and/or removably engage with respect to each other. Such engagement can allow surface engagement portion 160 to be mounted to a surface when movable portion 130 is not engaged with surface engagement portion 160, and thus without the additional weight of movable portion 130, and anything mounted to portion 130, such as a reel. Such engagement can also allow a first and second surface engagement portion 160 to be mounted at two locations, to allow movable portion 130 (and the remainder of reel mounting assembly 110, and the reel 10, if mounted thereto) to be removable and movable between these two locations.

The slidable and/or removable engagement of surface engagement portion 160 and movable portion 130 with respect to each other can be provided in a variety of ways. For example, surface engagement portion 160 and movable portion 130 can engage with a snap fit, interference fit, hooks, clips, tabs, latches, clasps, loops, guides, tracks, slots, grooves, pins, or other structures and techniques to provide slidable and/or movable functionality. In some embodiments, at least one of surface engagement portion 160 and movable portion 130 comprises a guide 161 configured to slidably and removably engage portions 130, 160 with respect to each other. For illustrative purposes only, guide 161 is described as being attached to portion 160, with corresponding guide engagement portions being attached to portion 130, but it will be understood that such a configuration can be reversed.

Referring to FIGS. 3A and 3B, guide 161 can allow the surface engagement portion 160 to removably and slidably engage with respect to the movable portion 130 in a first direction 510 (and disengage in direction 511). Guide 161 can also limit the movement of the surface engagement portion 160 with respect to the movable portion 130 in a second direction (e.g., directions 512 and/or 513). Directions 510, 511 will be defined herein as "longitudinal" directions, and directions 512, 513 will be defined herein as "lateral" directions with respect to the relative movement of surface engagement portion 160 and movable portion 130.

Guide 161 can comprise any of a variety of configurations, including one or more grooves, slots, tracks, and/or other suitable structure to guide two components with respect to each other. In the illustrated embodiment, guide 161 comprises one or more walls 161*a* extending from body 163 of surface engagement portion 160, with an additional wall 161*b* extending from wall 161*a*, to form a track, slot or gap 161*c* extending along a portion of body 163 (e.g., between wall 161*b* and body 163). Gap 161*c* can be configured to receive a corresponding wing, tab, flange, wall, pin or other corresponding guide-engagement structure 143 positioned on and/or extending from any of a number of portions of movable portion 130, such as upper portion 140. In the illustrated embodiment, the guide-engagement structure 143 extends from wall 144. In some embodiments, gap 161*c* can extend between wall 161*b* and one or more optional additional tabs or walls 161*d* (FIG. 3B) extending from body 163, to increase the accuracy and strength of the engagement between guide engagement structure 143 and guide 161.

Referring again to FIGS. 3A-3C, at least one of movable portion 130 and engagement portion 160 can comprise one or more stops to limit the movement of portions 130, 160 with respect to each other in one or more directions. The stops can be configured to limit longitudinal movement (e.g., in directions 510, 511), and/or lateral movement (e.g., in directions 512, 513) for example, when engagement portion 160 is slidably engaged with movable portion 130. Limiting such movement can prevent portions 130, 160 from disengaging from each other during use, and can increase the strength of the engagement between portions 130, 160, such as that provided by guide 161.

The illustrated embodiment shows several types of stops, any one or more of which can be implemented alone or in combination with each other or other types of stops. Additionally, while the stops are described as being attached to surface engagement portion 160, and movable to engage with movable portion 130, this configuration can be reversed, or the can be attached to another portion of base 120. Moreover, the stops are not limited to the embodiments shown, and can comprise any other type of wall, pin, tab, latch, block, screw or other stopping device that can provide similar limitations in movement between two components. The stops can limit movement through frictional engagement against a surface, or through interlocking features, such as a recess, slot, pin or other structure. The stops described herein can include one or more optional locking features to prevent disengagement of the stop with the structure for which it is limiting movement in one or more directions.

Stop 167 comprises a tab, flange, wall or other structure extending from surface engagement portion 160 and/or movable portion 130, such as a portion of bodies 163, 145, 151 (e.g., a lower surface thereof), guide 161, or walls 144, 143, and 154. Stop 167 can limit movement of movable portion in the first longitudinal direction 510 beyond a desired point, when movable portion 130 is slidably engaged with surface engagement portion 160. In some embodiments, stop 167 can comprise an optional additional latch, clamp, or other lock structure that limits the movement of movable portion 130 in the second longitudinal direction 511 when the locking structure is in a closed or locked position.

Stop 162 comprises a screw that can engage a portion of movable portion 130 with engagement portion 160. Screw 162 can be tightened against, or within, one or more portions of movable portion 130 and engagement portion 160, to limit lateral and/or longitudinal motion of these components in one or more directions. Screw 162 can extend through and thread into one or more openings (e.g., opening 168) extending through or into a portion of movable portion 130 or surface engagement portion 160, such as guide 161 (e.g., walls 161*a*, 161*b*, 161*d*), walls 144, 154, tabs 143, and/or bodies 163, 145, 151. Screw 162 can be tightened against a portion of the other of movable portion 130 and surface engagement portion 160, to limit lateral movement of movable portion 130. In some embodiments, a pin, slot, threaded opening, or recess, such as a laterally-recessed portion 143*a* of guide-engagement structure 143, can receive, contact, or otherwise engage with screw 162 (e.g., longitudinally), to lock or further limit longitudinal movement of movable portion 130.

Stop 166 comprises a plunger that can limit the movement of movable portion 130 with respect to engagement portion 160, substantially similar to screw 162 described above. Plunger 166 can include threads, or can be threadless. Plunger 166 can comprise a spring configured to hold plunger 166 in a locking (e.g., closed), or movement-limiting position. Plunger 166 can be moved between an open or unlocked and closed or locked position, to allow and limit movement, respectively, of movable portion 130 and engagement portion 160 with respect to each other. Plunger 166 can be configured in a variety of ways, and is shown extending through an opening 169 positioned at an end of track 161 opposite to stop 167 for illustrative purposes.

In the unlocked position, plunger 166 is disengaged with at least one of movable portion 130 and engagement portion 160, allowing movable portion 130 and engagement portion 160 to slidably move with respect to each other (e.g., within guide 161) in a first direction 510. In the locked position, plunger 166 is engaged with movable portion 130 and engagement portion 160, limiting the movement of movable portion 130 and engagement portion 160 (e.g., within guide 161) in one or more directions (e.g., directions 510 and/or 511). In a preferred embodiment, plunger 166 limits movement of movable portion 130 in direction 511, when movable portion 130 is slidably engaged with engagement portion 160, and when movement of movable portion 130 is limited in direction 510 by stop 167. Movable portion 130 and engagement portion 160 can be slidably disengaged with respect to each other by unlocking plunger 166 and moving portion 130 within guide 161 in second direction 511.

Continuing to refer to FIGS. 3A-3C, reel support 190 can be configured with a variety of shapes and materials suitable to support a reel (e.g., reel 10; FIG. 3C) and attach to engagement element 170. Reel support 190 can comprise one or more of any of a variety of support structures, such as members, arms, struts, frames, housings, and the like. In some embodiments, reel support 190 can comprise a pair of arms 192 used to engage reel mounting assembly 110 with a reel 10.

Arms 192 are not limited to an elongated curvilinear member, and can comprise a variety of elongated, non-elongated, straight, curvilinear, or other shapes and structures that can extend from another portion of reel mounting assembly 110, such as engagement element 170. Arms 192 can extend at various angles and orientations with respect to engagement element 170. In the illustrated embodiment, arms 192 extend radially outwardly from element 170. Arms 192 can be attached to each other, or an intermediary structure; in the illustrated embodiment, arms 192 are attached at their approximate proximal ends (e.g., at a central or medial portion of reel support 190). Arms 192 and engagement element 170 can be separately formed and attached to each other using a variety of the attachment methods known or described herein, or can be a unitary component.

Arms 192 can include a reel engagement portion 195 to engage with a reel 10. Preferably, the two reel engagement portions 195 are configured to pivotably engage with the sides (e.g., opposing sides) of a reel, such that the reel can pivot about a reel pivot axis 504 (FIG. 3C; 6A) extending through the two reel engagement portions 195. The engagement portions 195 can comprise any of the engagement elements described elsewhere herein, such as engagement elements 170, 180, or known in the art, to facilitate pivotable engagement between reel support 190 and a reel about axis 504. Engagement portions 195 can be formed separately from arms 192 or can be a single unitary construction. Arms 192 and/or reel engagement portions 195 can directly engage with or attach to reel 10, or can engage thereto with an intermediary structure. Reel engagement portions 195 can include, or can be attached to, additional optional structure that provides for removable or releasable attachment of reel 10 from reel mounting assembly 110. Reel engagement portions 195 can be positioned anywhere along the length and/or width of arms 192, and preferably are positioned proximate to a distal end 193 of arms 192. In some embodiments, a single arm 192 and a single engagement portion 195 can be implemented, without a second arm and engagement portion, provided they have sufficient strength to support reel 10.

Continuing to refer to FIGS. 3A-3C, engagement elements 170, 180, can comprise one or more of any of a number of devices that can facilitate a pivoting motion of base 120 and reel support 190 about an axis. Preferably, engagement elements 170, 180 facilitate a pivoting motion of base 120 and reel support 190 about at least two axes, such as two approximately orthogonal axes extending through the engagement elements, such as at least two of axes 501, 502 and 503 (FIG. 3C). In some embodiments, the engagement elements 170, 180 can facilitate a pivoting motion of base 120 and reel support 190 about any axis within a plane containing the approximately orthogonal axes. In some embodiments, the base 120 and the reel support 190 can pivot with respect to each other about at least three approximately orthogonal axes extending through the engagement elements 170, 180. In some embodiments, reel mounting assembly 110 comprises one or more locking devices to selectively allow and restrict any of the aforementioned pivoting motion provided by engagement elements 170, 180 and reel engagement portions 195, once a reel hanging from assembly 110 is in a desired position.

Examples of suitable engagement elements include rotary actuators, pins, guides, tracks, slots, grooves, bearings, cams, hubs, motors, bearings, hinges, axles, rotational joints, clutches, discs, gears, ball and sockets assemblies, and the like. It will be understood that although some of these examples of engagement elements may only allow motion about a single axis, two or more of such examples may be combined to facilitate the preferred motion about at least two axes (e.g., using two of the same, or two different types of single-axis engagement elements). The engagement elements of the illustrated embodiment comprise a socket portion 170 and a ball member or ball portion 180 that form a ball and socket assembly 185.

Socket portion 170 can comprise a sleeve 172 comprising a first opening 176 at its proximal end, and second opening 174 at its distal end. Sleeve 172 comprises a sidewall 173 extending between openings 176 and 174, forming a channel 171. Sleeve 172, channel 171, and openings 174 and 176 can have many different regular or irregular cross-sectional shapes, and need not be circular (or cylindrical, in a three dimensional system).

Opening 176 is generally a size and shape suitable to support and facilitate pivotable engagement between a ball 182 of ball portion 180 and a socket 178 of socket portion 170. In the illustrated embodiment, opening 176 is approximately circular, to form the socket 178. In some embodiments, a bushing, or other suitable intermediary structure can be inserted between opening 176 and ball 182, to form socket 178 and provide the aforementioned pivotable engagement. Socket 178 can include tapered or radiused edges to facilitate the aforementioned pivotable engagement. In some embodiments, opening 176 is smaller than opening 174, to allow ball portion 180 to be extended through opening 174 (e.g., and through channel 171), such that ball 182 can engage with socket 178, without allowing ball 182 to pass through opening 176. In the illustrated embodiment, arms 192 of reel support 190 also include an opening 194, to allow passage of ball 182 through opening 194 and opening 174, when socket portion 170 is attached to reel support 190. Such an embodiment can allow socket portion 170 to be attached to reel support 190 prior to attaching ball portion 180 thereto.

The perimeter of channel 171 need not be closed along the entirety of the longitudinal length of channel 171. Thus, portions of sidewall 173 can extend partially around portions of channel 171 to form an at least partially open channel, providing radial or transverse access to the channel interior. Channel 171 can have many different shapes and sizes, and can comprise tapered (e.g., curved or angled) edges or sidewalls, or stepped or radiused shoulders.

The cross-sectional area of opening 174 need not be orthogonal to an axial or longitudinal axis extending through sleeve 172, and can be oriented to be approximately orthogonal to or at a variety of angles with respect to a longitudinal, axial, radial or transverse axis extending through sleeve 172. Generally, opening 174 is sized, shaped and oriented to provide access to the interior of sleeve 172, to allow the aforementioned extension of ball portion 180 through channel 171 from opening 174 to opening 176. Moreover, opening 174 is optional; in some embodiments, sleeve 172 and socket 178 can comprise two or more separate sections or halves, that are separable or split (e.g., along an approximately longitudinal axis), allowing the halves to engage socket 178 and opening 176 around ball portion 180 without extending the ball portion 180 through an additional opening such as opening 174.

Sleeve 172 can include a variety of cross-sectional and 3-dimensional shapes, such as those described herein for base 120, or other suitable shapes, and can vary in cross-sectional shape and size along its length and width. The entirety of sleeve 172 need not be hollow, and can include substantially hollow and/or solid portions. The outer surface of sleeve 172 can form an approximately cylindrical, conical, frustro-conical, rectangular, pyramidal, or frustro-pyramidal shape. Sleeve 172 is generally shaped and of a length sufficient to facilitate the pivotability and freedom of movement between reel support 190 and base 120 described herein, while reducing or limiting interference between these components. It will be understood that sleeve 172 is optional. For example, an opening and socket, functioning similar to opening 176 and socket 178, can extend through and be formed within a portion of reel support 190, such as arms 192. The outer surface of sleeve 172 can have a similar or different shape with respect to channel 171.

In some embodiments, socket portion 170 can include an optional notch 175 extending through sidewall 171 and a portion of opening 176. Notch 175 can be sized and shaped to receive a portion of ball portion 180 (e.g., a stem 184 attached to ball 182). Notch 175 can allow additional freedom of movement of ball portion 180 with respect to socket portion 170, and additional mounting flexibility of reel mounting apparatus 110, as described further below (see also FIG. 6B).

Engagement elements 170, 180 can be attached (e.g., permanently or removably) to the reel support 190 and base 120, respectively, using any of the attachment structures and methods known or described herein for attaching two or more components, such as with a snap fit, interference fit, hooks, clamps, latching, bonding, welding, adhesive, fasteners, threads, and the like. Engagement elements 170, 180 can be integrally formed with support 190 and base 120, respectively, or can be a unitary construction. Engagement elements 170, 180 can be positioned anywhere along the length and/or width of reel support 190 (e.g., arms 192) and base 120 (e.g., movable portion 130), respectively.

A flange portion 179 can extend from a portion (e.g., a proximal end) of sleeve 172 to facilitate attachment of socket portion 170 to reel support 190. Flange 179 can be attached to reel support 190 with one or more fasteners 179*a* extending through one or more openings (e.g., threaded openings) 179*b* extending through flange 179 and corresponding openings 196 extending through reel support 190. Flange 179 can extend from sleeve 172 at a variety of positions along the length of sleeve 172, and can extend inwardly or outwardly with respect to channel 171. In the illustrated embodiment, flange 179 extends outwardly, to allow the aforementioned extension of ball portion 180 through opening 174 and channel 171. Flange 179 can be mounted to an upper or lower portion (e.g., surface) of reel support 190. In the illustrated embodiment, flange 179 mounts to a lower surface of reel support 190, to provide additional support between socket portion 170 and reel support 190 in a downward direction when a reel is attached to reel support 190.

Ball portion 180 includes stem 184 attached to and extending from ball 182, to provide attachment to base 120. Stem 184 can comprise any of the aforementioned shapes described for sleeve 172, or other suitable shapes. Stem 184 is generally suitably shaped and of a length sufficient to facilitate the pivotability and freedom of movement between reel support 190 and base 120 described herein, while reducing or limiting interference between these components. In the illustrated embodiment, stem 184 comprises an elongated, substantially cylindrical member. Stem 184 can be attached directly to a portion of base 120, or with an intermediary structure.

Ball portion 180 can include an optional flange portion 186 extending from a portion (e.g., a proximal end) of stem 184 to facilitate attachment of ball portion 180 to base 120. Flange 186 can extend from stem 184 at a variety of positions and angles along the length of stem 184. Flange 186 can be any of the variety of shapes described herein for stem 184, or other suitable shapes, and can be the same or different shape with respect to stem 184. Flange 186 can be sized to allow its insertion and extension through opening 176 and socket 178, and optional opening 174 of socket portion 170. Flange 186 can be mounted to an upper or lower portion (e.g., surface) of base 120.

In some embodiments, a portion of base 120 can include an opening and a slot to facilitate the attachment of flange 186 thereto. For example, lower portion 150 can include a plate or body opening 152 and a plate or body slot 153 connected to opening 152. Opening 152 and slot 153 can extend partially or completely through plate or body 151 of lower portion 150.

The opening 152 can be configured to allow the flange 186 to move through the opening 152 when the ball portion 180 (e.g., the flange 186) is at a first transverse position with respect to the lower portion 150 of the base 120. For example, the first transverse position can correspond to a location of ball portion 180 such that the approximate center of the ball 182 (e.g., the approximate longitudinal axis of stem 184) is approximately aligned with a line extending orthogonally to and through the approximate center of the cross-sectional area formed by opening 152. The slot 153 can be configured to receive the stem 184 of ball portion 180, and restrict the flange 186 from moving through the body or plate 151 when the stem is extended through the slot 153 at a second transverse position of the ball portion 180 with respect to the lower portion 150. The second transverse position can correspond to a location of ball portion 180, for example, wherein flange 186 is positioned on one side of plate 151 (e.g., an upper side) and ball 182 is positioned on the opposed side of plate 151 (e.g., a lower side), and stem 184 extends through slot 153 and between flange 186 and ball 182. In the second position, movement of ball portion 180 through slot 153 is limited or restricted in one direction by contact between flange 186 and a first surface (e.g., upper surface) of lower portion 150, and in a second, opposed direction by contact between ball 182 and a second surface (e.g., lower surface) of lower portion 150. In this way, ball portion 180 can be secured or attached to base 120 (e.g., lower portion 150) when in the second position, and can be removed or detached from base 120, when in the first position.

In some embodiments, a stop can be provided to restrict or limit transverse movement of ball portion 180 from the second transverse position to the first transverse position, when the lower portion 150 is engaged with the upper portion 140 and the stem 184 is extended through the slot 153. A stop can prevent stem 184 from sliding from the second position and along slot 153, and from allowing flange 186 pass back through opening 152, causing ball portion 180 to detach from base 120. Any of the stop devices known or described herein can provide such functionality. In the illustrated embodiment, a stop 141 is configured to extend from a portion (e.g., a bottom surface) of upper portion 140, and extend between opening 152 and slot 153, to restrict motion of ball portion 180 between the second and first transverse position.

Additionally or alternatively, ball portion 180 can be secured to base 120 with one or more fasteners extending through one or more openings in a portion of base 120 (e.g., portions 140, 150, 160), and engaging with a portion of ball portion 180 (e.g., flange 186). In the illustrated embodiment, a fastener 147 extends through an opening 148 in upper portion 140 and engages with flange 186 (e.g., when ball portion 180 is in the second position, and the stem 184 extends through slot 153). A washer 147*a* can be used with fastener 147 to prevent movement of fastener 147 through opening 148. An optional stop, configured as one or more tabs 142 extending from a portion of upper portion 142 (e.g., its lower surface), can be configured to engage with a corresponding slot, groove, or recess 183 on ball portion 180 (e.g., on an upper surface of flange 186). Tabs 142 and recess 183 can provide further engagement between ball portion 180 and base 120, for example, to limit rotation therebetween, and prevent fastener 147 from loosening.

Reel mounting assembly 110 and its engagement elements 170, 180 provide previously unknown freedom of movement and mounting options in a reel mounting apparatus. The embodiments described herein provide the ability for base 120 and reel support 190 to pivot about axes 501, 502, 503, and any other axis extending through engagement elements 170, 180, and provide the ability to mount reel mounting assembly 110 on a surface of virtually any angle and inclination. In some embodiments, reel mounting assembly 110 can allow a reel hanging therefrom to pivot about a reel pivot axis 504. These mounting options and pivotability can reduce shock when spooling and unspooling linear material, can allow a reel hanging from reel mounting assembly to move in the direction of the linear material being spooled or unspooled from the reel, and/or can provide a self-leveling feature. Any and all of this functionality increases the accuracy, reliability, and consistency of the spooling and unspooling process.

FIGS. 4-6C illustrate various views of embodiments of reel mounting assembly 110 supporting a reel 10. Phantom lines and angles are provided to illustrate the freedom of movement and various mounting orientations provided by reel mounting assembly 110. It will be understood that the axes 501-503 (or derivatives thereof, such as axes 501*a*, etc.) are shown for illustrative purposes only, and that base 120 and reel support 190 of reel mounting assembly 110 can pivot with respect to each other about any axis within a plane containing two of axes 501-503 (or derivatives thereof). It will be understood also that the angles shown in FIGS. 4-6C are shown in one direction with respect to an axis for illustrative purposes only, and that the pivot motion shown and described can be applied in the reverse direction from that shown unless stated otherwise.

Figure 4:
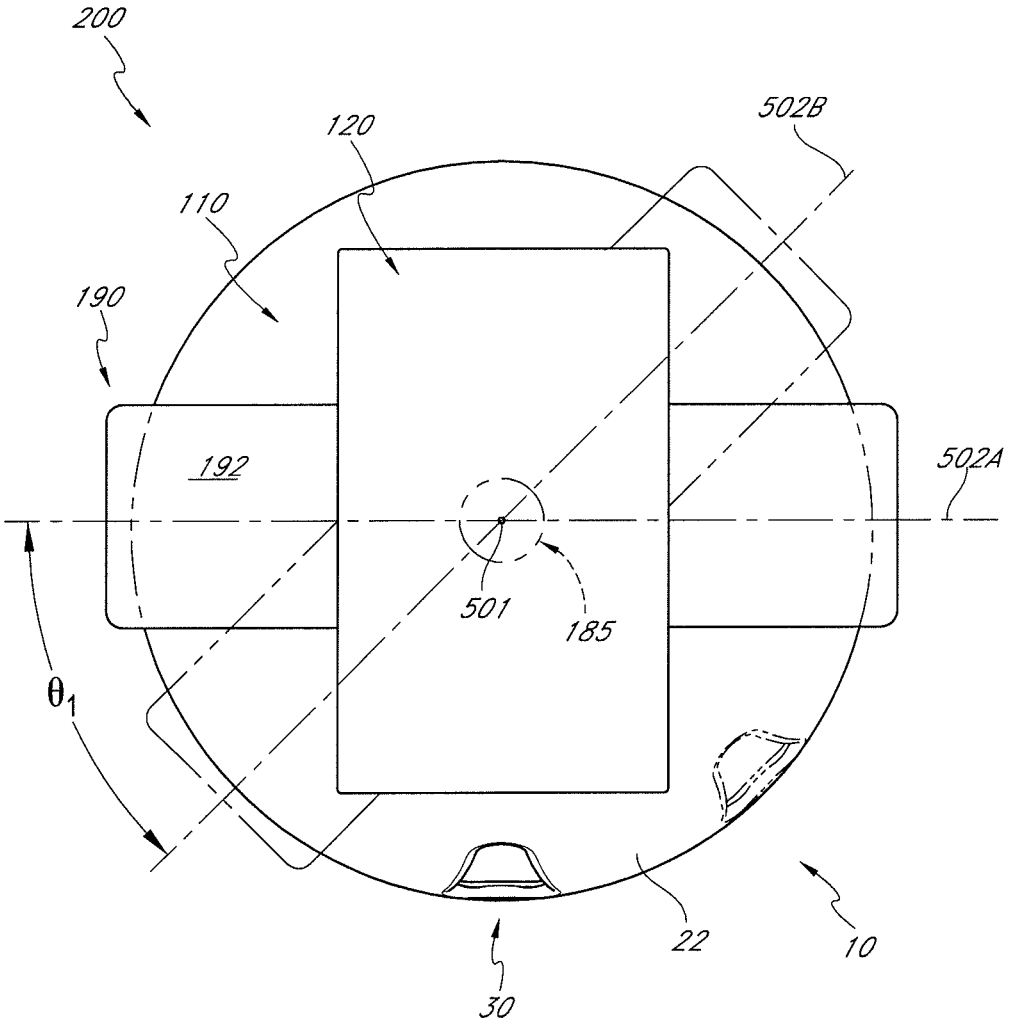
FIG. 4 is a top view of an embodiment of a reel mounting assembly showing a base and a reel support pivoting with respect to each other about a first axis.

FIG. 4 is a top view of an embodiment of reel mounting assembly 110 showing base 120 and the reel support 190 pivoting with respect to each other about a first axis 501 by an angle $\theta_1$. Axis 501 can extend through one or more of rotatable elements 170, 180. In some embodiments, axis 501 can be substantially vertical. In some embodiments, base 120 and reel support 190 can freely pivot about axis 501, i.e., such that angle $\theta_1$ is 360 degrees or more.

Figure 5:
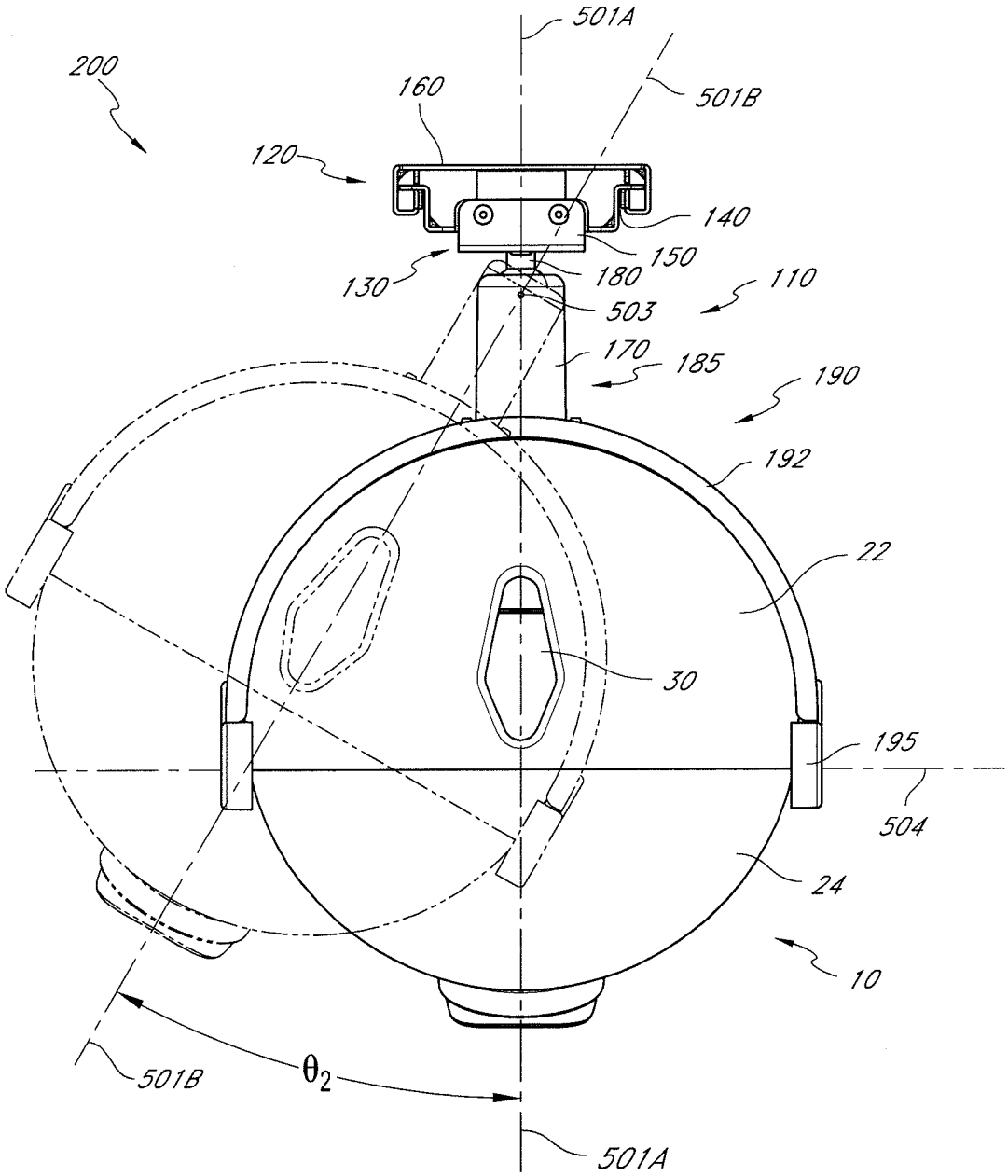
FIG. 5 is a front view of the reel mounting assembly of FIG. 4 showing a base and a reel support pivoting with respect to each other about a second axis.

FIG. 5 is a front view of the reel mounting assembly 110 of FIG. 4 showing base 120 and the reel support 190 pivoting with respect to each other about a second axis 503 by an angle $\theta_2$. In some embodiments, axis 503 can extend through one or more of rotatable elements 170, 180. Axis 503 can be approximately orthogonal to a plane in which arms 192 extend, or at other angles with respect to such a plane of the arms 192 (FIG. 6C). Axis 503 can be approximately horizontal.

Figure 6A:
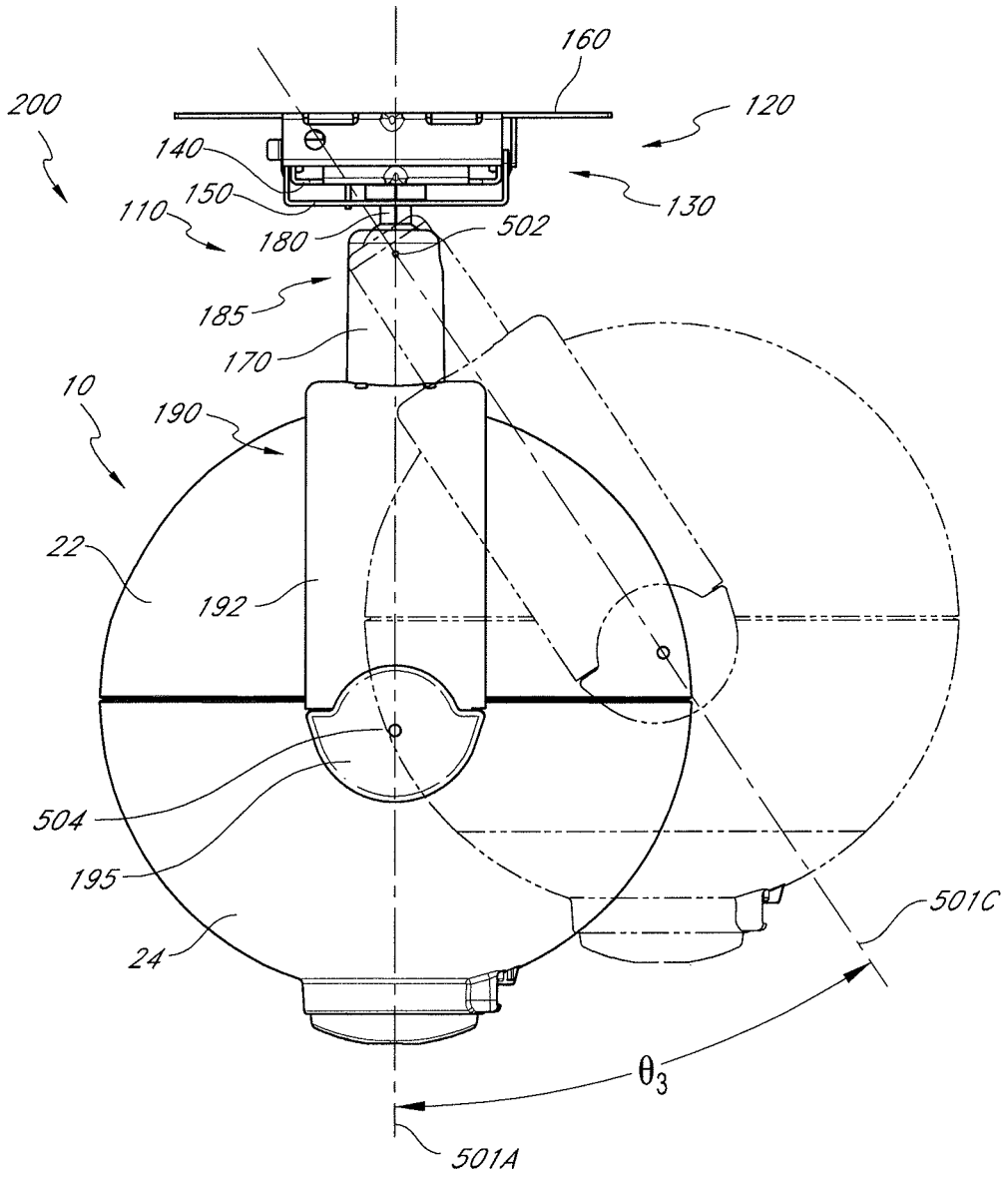
FIG. 6A is a side view of the reel mounting assembly of FIG. 4 showing a base and a reel support pivoting with respect to each other about a third axis.

FIG. 6A is a side view of the reel mounting assembly 110 of FIG. 4 showing base 120 and the reel support 190 pivoting with respect to each other about a third axis 502 by an angle $\theta_3$. In some embodiments, axis 502 can extend through one or more of rotatable elements 170, 180. Axis 502 can be approximately parallel with a plane in which arms 192 extend. Axis 502 can be approximately horizontal. Allowing base 120 and the reel support 190 to pivot about axis 502 can allow reel 10 to move forward and backwards to compensate for the variations in tension as a linear material is spooled and unspooled from reel 10. FIG. 6A also shows reel 10 rotating about reel pivot axis 6A (see also FIG. 3C), which can provide a self-leveling feature to reel 10 as the base 120 and reel support 190 pivot through angle $\theta_3$.

Figure 6B:
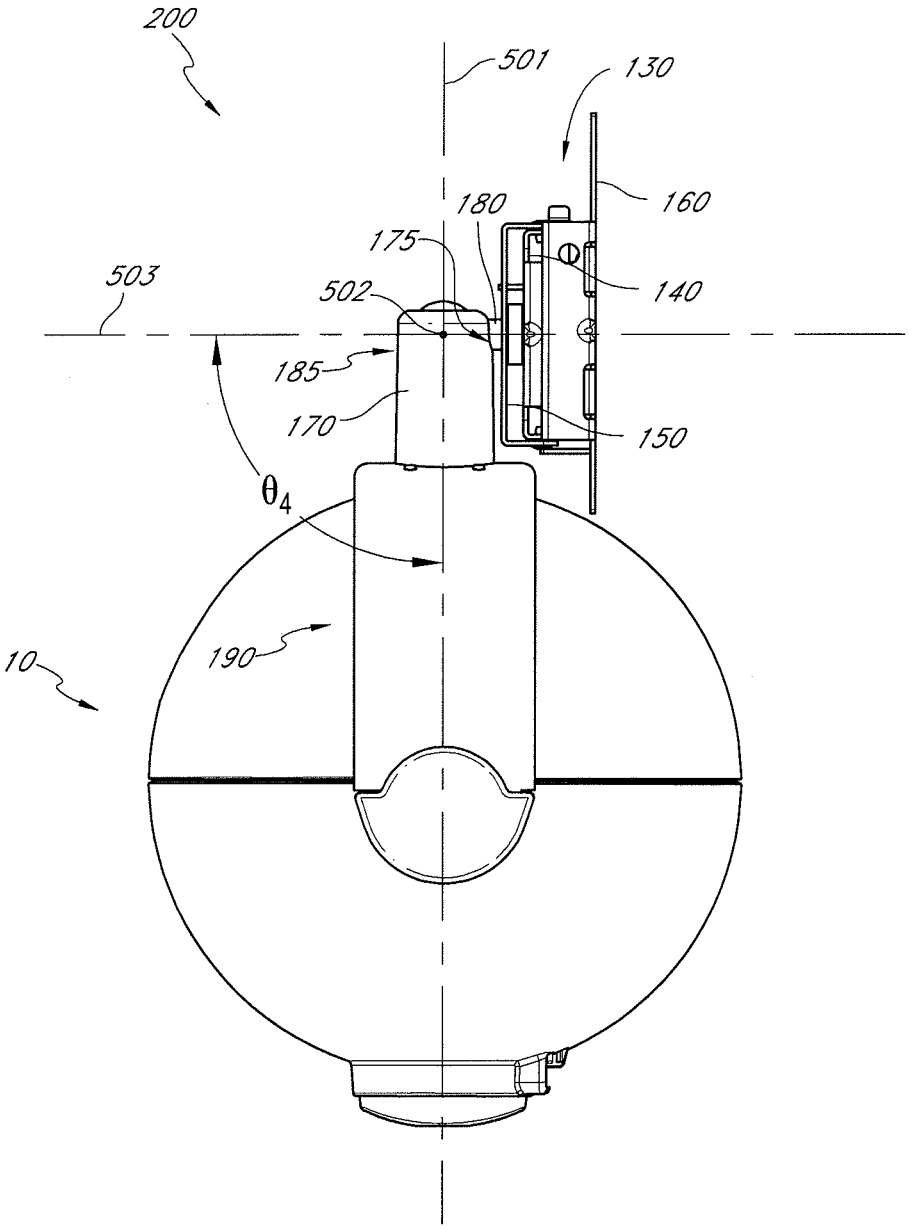
FIG. 6B is a side view of a vertically-mounted reel mounting assembly.
Figure 6C:
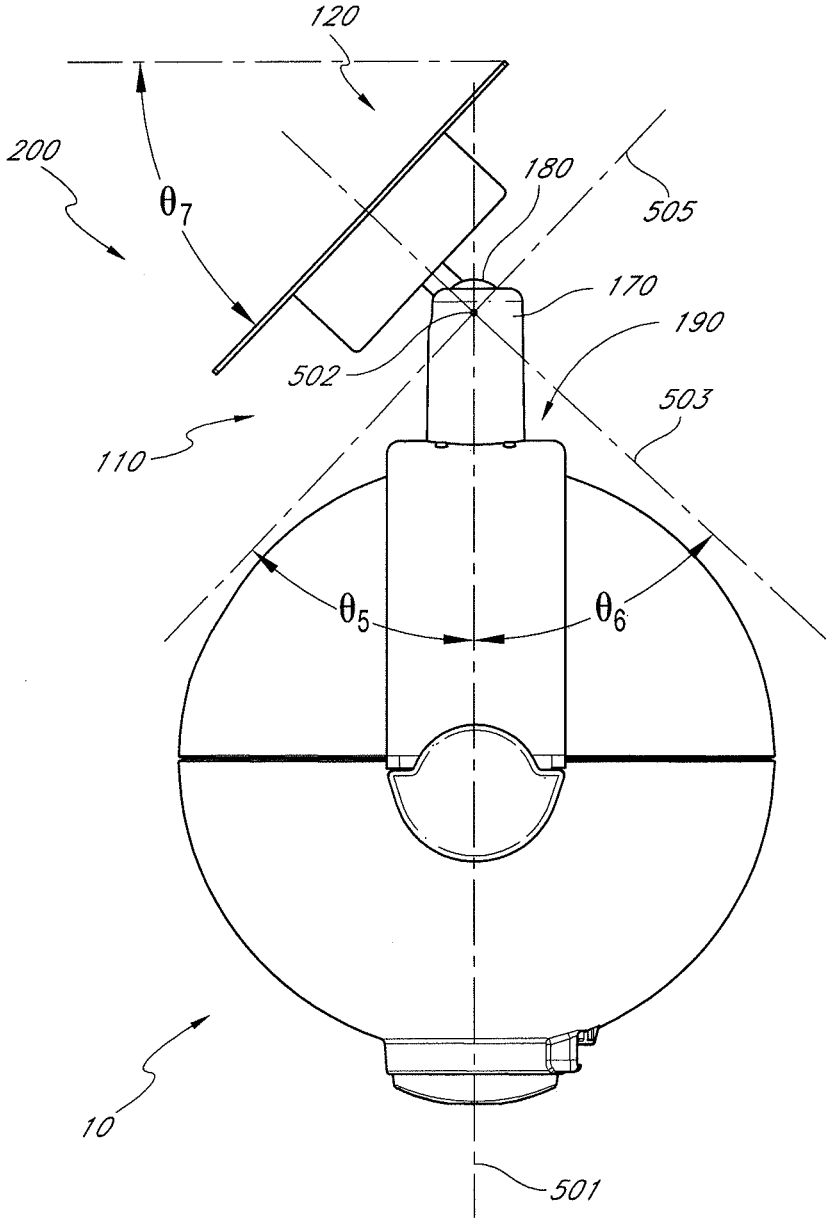
FIG. 6C is a side view of a reel mounting assembly with a base that is mounted at an angle relative to horizontal.

FIG. 6B is a side view of a vertically-mounted reel mounting assembly 110. In some embodiments, axis 502 can extend through one or more of rotatable elements 170, 180. Axis 502 can be approximately parallel with a plane in which arms 192 extend. Axis 502 and/or axis 503 can be approximately horizontal. Axis 503 can comprise a longitudinal axis of the stem 184 of ball portion 180. Axis 501 can comprise a longitudinal axis of the sleeve 172 of socket portion 170. Angle $\theta_4$ can be defined as the angle between axes 503 and 501 (e.g., the angle between the longitudinal axis of the stem 184 and sleeve 172). Notch 175 of socket portion 170 can receive the stem 184 to allow the sleeve 172, when the reel support 190 is hanging from the base 120, to pivot about axis 502 (e.g., a horizontal axis) extending through the ball portion 180 and socket 178. In some embodiments, such pivoting can allow the difference in the outer values of angle $\theta_4$ to be approximately 145 degrees. In some embodiments, the difference in the outer values of angle $\theta_4$ can be approximately 180 degrees. For example, the socket portion 170 can be pivoted with respect to ball portion 180 about axis 502 to an angle $\theta_4$ that corresponds to a point where socket portion 170 can be pivoted about axis 503 without interference between notch 175 and stem 184 (e.g., approximately 90 degrees). Subsequently, socket portion 170 can be pivoted about axis 503 to change the alignment of socket portion 170, and allow further pivotability of socket portion 170 with respect to ball portion 180 (e.g., about axis 502; e.g., as much as approximately 90 degrees). In this way, reel mounting assembly 110 can be mounted on a vertical surface, or any other surface of any angle relative to horizontal, while still allowing the reel support 190 and base 120 to pivot with respect to each other about at least two orthogonal axes.

FIG. 6B also illustrates an embodiment wherein base 120 and reel support 190 can pivot about axis 503 by 360 degrees or more.

FIG. 6C is a side view of a reel mounting assembly 110. The features and functionality shown in FIG. 6C are substantially similar to those shown in FIG. 6B. The main difference is that base 120 is mounted at an angle $\theta_7$ relative to horizontal. Such an angled mount of base 120 can allow base 120 and reel support 190 to pivot about axis 502 in the direction illustrated by angle $\theta_6$, and similar to the pivotability shown by angle $\theta_4$ in FIG. 6B. In this embodiment, because of the angled mounting of base 120, base 120 and reel support 190 can further pivot about axis 502 in the opposed direction illustrated by angle $\theta_5$.

FIG. 6C also provides an example of an embodiment of reel mounting assembly 110 that includes a base 120 with a simpler design (e.g., without subcomponents such as portions 160, 130, or their subcomponents (such as portions 140, 150 of 130). Such an embodiment is provided for illustration purposes, and can be implemented in the embodiments shown in the other FIGS. 3A-6B. Moreover, the embodiments of base 120 in the other FIGS. 3A-6B can be implemented in that of FIG. 6C.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein.

What is claimed is:

1. A reel mounting assembly comprising:

a base configured to mount to a surface; and a reel support configured to support a reel hanging from the reel support;

wherein the base and reel support each have engagement elements configured to pivotably engage one another, such that the base and the reel support can pivot with respect to each other about at least two approximately orthogonal axes extending through the engagement elements, wherein the engagement of the engagement elements allows the reel support, when hanging from the base, to freely rotate 360 degrees or more about one of the at least two orthogonal axes, wherein the engagement elements comprise a ball portion and a socket portion that form a ball and socket assembly, wherein the socket portion comprises:

a sleeve comprising a first end with a first opening and a second end with a second opening, the second opening smaller than the first opening and forming a socket at the second end of the sleeve; and an inner channel extending between the first and second opening; and the ball portion comprises a ball configured, when extended through the inner channel, to pass through the first opening and engage with the socket without passing through the second.

2. The reel mounting assembly of claim 1, wherein the base and the reel support can pivot with respect to each other about at least three approximately orthogonal axes extending through the engagement elements.

3. The reel mounting assembly of claim 1, wherein the engagement elements engage one another such that the base and the reel support can pivot with respect to each other about any axis extending through the engagement elements and within a plane containing said two approximately orthogonal axes.

4. The reel mounting assembly of claim 1, wherein the reel support comprises a pair of arms each having a reel engagement portion, the two reel engagement portions configured to pivotably engage with opposing sides of a reel, such that the reel can pivot about a reel pivot axis extending through the two reel engagement portions.

5. The reel mounting assembly of claim 1, wherein the one of the at least two orthogonal axes comprises an approximately vertical axis.

6. The reel mounting assembly of claim 1, wherein the one of the at least two orthogonal axes comprises an approximately horizontal axis.

7. The reel mounting assembly of claim 1, wherein:

the ball portion further comprises a stem extending from the ball; and the sleeve comprises a sidewall and a notch extending through the sidewall and a portion of the socket, the notch sized to receive the stem to allow the sleeve, when the reel support is hanging from the base, to pivot about a horizontal axis extending through the ball portion and socket, such that the differences in the outer values of an angle between a longitudinal axis of the stem and a longitudinal axis of the sleeve is approximately 145 degrees.

8. The reel mounting assembly of claim 1, further comprising the reel, the reel being supported by the reel support.

9. A reel mounting assembly comprising:

a base configured to mount to a surface; and a reel support configured to support a reel hanging from the reel support, wherein the base and reel support each have engagement elements configured to pivotably engage one another, such that the base and the reel support can pivot with respect to each other about at least two approximately orthogonal axes extending through the engagement elements, wherein the engagement of the engagement elements allows the reel support, from the base, to freely rotate 360 degrees or more about one of the at least two orthogonal axes;

wherein the base comprises:

a surface engagement portion configured to mount to said surface; and a movable portion from which extends the engagement element of the base, wherein at least one of the surface engagement portion and the movable portion comprises a guide configured to removably and slidably engage the surface engagement portion in a first direction with respect to the movable portion, and limit movement of the surface engagement portion with respect to the movable portion in a second direction.

10. The reel mounting assembly of claim 9, wherein at least one of the surface engagement portion and the movable portion comprises one or more stops configured to limit movement of the surface engagement portion with respect to the movable portion in the first direction.

11. The reel mounting assembly of claim 10, wherein at least one of the surface engagement portion and the movable portion comprises one or more stops configured to limit movement of the surface engagement portion with respect to the movable portion in a third direction opposed to the first direction and approximately orthogonal to the second direction.

12. The reel mounting assembly of claim 9, wherein:

the engagement element of the base comprises a ball member having a ball, a stem having a first end connected to the ball, and a flange connected to a second end of the stem;

the engagement element of the reel support comprises a socket, the ball and the socket forming a ball and socket assembly;

the movable portion comprises an upper portion and a lower portion configured to engage with the upper portion, the lower portion comprising a plate with a plate opening connected to a slot, the plate opening and the slot extending through the plate;

wherein the plate opening is configured to allow the flange to move through the opening when the ball member is at a first transverse position with respect to the lower portion; and the slot is configured to receive the stem and restrict the flange from moving through the plate when the stem is extended through the slot at a second transverse position of the ball member with respect to the lower portion.

13. The reel mounting assembly of claim 12, wherein the upper portion of the movable portion comprises a stop configured to restrict transverse movement of the ball member from the second transverse position to the first transverse position when the lower portion is engaged with the upper portion and the stem is extended through the slot.

14. The reel mounting assembly of claim 9, wherein the base and the reel support can pivot with respect to each other about at least three approximately orthogonal axes extending through the engagement elements.

15. A reel mounting assembly comprising:

a base configured to mount to a surface;

a reel support configured to support a reel hanging from the reel support; and a ball and socket assembly configured to pivotably engage the base and the reel support with one another, such that the base and the reel support can provide self-leveling to a reel hanging from the reel support, wherein the ball and socket assembly comprises a ball portion and a socket portion, wherein:

the socket portion comprises:

a sleeve comprising a first end with a first opening and a second end with a second opening, the second opening smaller than the first opening and forming a socket at the second end of the sleeve; and an inner channel extending between the first and second opening; and the ball portion comprises a ball configured, when extended through the inner channel, to pass through the first opening and engage with the socket without passing through the second opening.

16. The reel mounting assembly of claim 15, wherein the base and the reel support can pivot with respect to each other about at least two approximately orthogonal axes extending through the ball and socket assembly to provide the self-leveling to a reel hanging from the reel support.

17. The reel mounting assembly of claim 16, wherein the ball and socket assembly allows the reel support, when hanging from the base, to rotate freely 360 degrees or more about one of the at least two orthogonal axes.

18. The reel mounting assembly of claim 16, wherein the base and the reel support can pivot with respect to each other about at least three approximately orthogonal axes extending through the ball and socket assembly.

19. The reel mounting assembly of claim 15, wherein the reel support comprises a reel engagement portion configured to allow the reel to pivot relative to the reel support about a reel pivot axis, wherein the self-leveling is provided by allowing rotation of the reel relative to the reel support about the reel pivot axis, and rotation of the reel support relative to the base about an axis extending through the ball and socket assembly and approximately parallel with the reel axis.

20. The reel mounting assembly of claim 15, wherein:

the ball portion further comprises a stem extending from the ball; and the sleeve comprises a sidewall and a notch extending through the sidewall and a portion of the socket, the notch sized to receive the stem to allow the sleeve, when the reel support is hanging from the base, to pivot about a horizontal axis extending through the ball portion and socket, such that the differences in the outer values of an angle between a longitudinal axis of the stem and a longitudinal axis of the sleeve is approximately 145 degrees.

21. The reel mounting assembly of claim 15, further comprising the reel, the reel being supported by the reel support.

22. A reel mounting assembly comprising:

a base configured to mount to a surface;

a reel support configured to support a reel hanging from the reel support; and a ball and socket assembly configured to pivotably engage the base and the reel support with one another, such that the base and the reel support can provide self-leveling to a reel hanging from the reel support, wherein the ball and socket assembly comprises:

a ball member having a ball, a stem having a first end connected to the ball, and a flange connected to a second end of the stem; and a socket;

wherein the base comprises a plate with a plate opening connected to a slot, the plate opening and the slot extending through at least a portion of the base;

wherein the plate opening is configured to allow the flange to move through the opening when the ball member is at a first transverse position with respect to the lower portion; and the slot is configured to receive the stem and restrict the flange from moving through the at least a portion of the base when the stem is extended through the slot at a second transverse position of the ball member with respect to the plate.

23. The reel mounting assembly of claim 22, wherein the base comprises a stop configured to restrict transverse movement of the ball member from the second transverse position to the first transverse position when the stem is extended through the slot.

24. The reel mounting assembly of claim 23, wherein the base comprises:

a surface engagement portion configured to mount to said surface; and a movable portion comprising an upper portion and a lower portion configured to engage with the upper portion, the lower portion comprising the plate;

wherein at least one of the surface engagement portion and the movable portion comprises a guide configured to removably and slidably engage the surface engagement portion in a first direction with respect to the movable portion, and limit movement of the surface engagement portion with respect to the movable portion in a second direction.

25. The reel mounting assembly of claim 22, wherein the base and the reel support can pivot with respect to each other about at least two approximately orthogonal axes extending through the ball and socket assembly to provide the self-leveling to a reel hanging from the reel support.

26. The reel mounting assembly of claim 25, wherein the base and the reel support can pivot with respect to each other about at least three approximately orthogonal axes extending through the ball and socket assembly.

* * * * *

UNITED STATES PATENT AND TRADEMARK OFFICE

CERTIFICATE OF CORRECTION

PATENT NO. : 8,925,851 B2
APPLICATION NO. : 13/566097
DATED : January 6, 2015
INVENTOR(S) : James B. A. Tracey et al.

It is certified that error appears in the above-identified patent and that said Letters Patent is hereby corrected as shown below:

In the Claims,

In column 15 at line 65, In Claim 1, change "second." to --second opening--.

In column 16 at line 45, In Claim 9, change "support," to --support, when hanging--.

Signed and Sealed this
Twenty-second Day of September, 2015

Michelle K. Lee

Michelle K. Lee
*Director of the United States Patent and Trademark Office*